United States Patent [19]

Pace et al.

[11] 4,001,621

[45] Jan. 4, 1977

[54] INCANDESCENT LAMP HAVING A REFLECTING DOME AND SPHEROCONICAL ENVELOPE

[75] Inventors: Henri Pacé, Bures-sur-Yvette; Marcel Lavedrine, Garches; Jean Berdou, Bois-Colombes, all of France

[73] Assignee: U.S. Philips Corporation, New York, N.Y.

[22] Filed: July 17, 1975

[21] Appl. No.: 596,661

[30] Foreign Application Priority Data

Dec. 24, 1974 Spain ..... 433316

[52] U.S. Cl. ..... 313/113; 240/41.1; 240/41.35 R

[51] Int. Cl.[2] ..... H01K 1/32

[58] Field of Search ..... 313/113–115, 313/117; 240/41.1, 41.35 R, 103 R

[56] References Cited

UNITED STATES PATENTS 2,826,710 3/1958 Lipscomb ..... 313/117 X

FOREIGN PATENTS OR APPLICATIONS 1,147,918 12/1957 France ..... 313/113

*Primary Examiner*—Siegfried H. Grimm
*Attorney, Agent, or Firm*—Frank R. Trifari; Robert S. Smith

[57] ABSTRACT

A high voltage lamp having a silvered dome and reduced dimensions comprising a reflecting dome surface of a spheroconical shape which permits, by double reflection of light rays, an acceptable temperature of the cap for a power of 60W in a lamp of 45 mm diameter and 85 mm height.

4 Claims, 3 Drawing Figures

INCANDESCENT LAMP HAVING A REFLECTING DOME AND SPHEROCONICAL ENVELOPE

The invention relates to an incandescent lamp having a reflecting dome.

Such lamps are known in which the part of the generally hemispherical envelope opposite to the cap is coated with a reflecting metallic deposit which has for its object to reflect on both sides of the cap the light emitted towards the upper part of the envelope. Said lamps are used in particular when the incandescent filament is to be hid from view, for example, in certain kinds of projectors, the light being then recaptured by a reflector and returned towards the zone to be lighted while avoiding dazzling, or when it is desired to light up the zone placed precisely on the side of the cap, which is the case notably for portable lamps destined to comparatively intensely illuminate limited zones.

Although the manufacture of such lamps is relatively common, it is nevertheless remarkable that for powers equivalent to those of so-called "bright" lamps, the dimensions are often larger. Such "bright" lamps have a transparent envelope and no reflecting deposit. This can easily be explained by remarking that the bright lamp dissipates its luminous and calorific power at an angle of nearly 360°, the difference being represented by the solid angle which the cap occupies, while in a lamp having a silvered envelope the dissipation occurs only through 180° and the cap receives nearly two times more power and hence a much higher temperature. The result is an abnormal heating of the cap which may have for its result that the cement of the cap is adversely influenced. Another result is an abnormal heating of the holder and its connection wires which may present problems as regards the behaviour of the lighting fitting.

Moreover, the light rays which accompany the calorific rays experience an important loss by the reflections and absorptions due to the geometry of the assembly.

On the other hand, the actual tendency goes towards the reduction of the volume of the lamp, that is the spherical lamps of 45 mm diameter and 74.5 mm height actually known permit to obtain for a voltage of 225 V a power of 40 W and of 60 W in the bright version and only 40 W in the bright version having a silvered dome. It has actually not been possible to manufacture spherical lamps of 60 W having an acceptable cap temperature.

It is the object of the invention to provide lamps having a reflecting dome of a geometry which is adapted to said type of light source with a view to reducing the calorific and luminous losses so as to obtain with respect to the known lamps:

a lower cap temperature, lower losses of luminous flux.

The result is in particular the possibility of manufacturing a lamp of 60 W–225 V having a silvered dome of reduced dimensions and an acceptable cap temperature.

In a lamp of the type defined above, a part of the radiation emitted by the filament reflects at the surface of the silvering and is returned, after a reflection, towards the lower part of the envelope. A part of the said radiation leaves the lamp and participates in the illumination, another weaker part falls on the cap. The part of the reflected rays in the cap corresponds substantially to a solid angle of 20°.

It is the object of the invention to reduce the temperature at the lamp cap by limiting the quantity of rays reflected in the cap. This result is obtained by giving the dome of the envelope a particular structure which permits of reducing by half the solid angle determined by the stray rays falling on the cap, those experiencing a double reflection.

The incandescent lamp according to the invention is characterized in that at least the part of the envelope having the reflecting dome has such a shape that rays issued from the filament and falling on the said dome experience at least two reflections before reaching the cap. The shape of said part is such that the light losses by reflection and double reflection are actually much smaller than in the known lamps.

According to a preferred embodiment the envelope has a spheroconical shape, the part present below the boundary plane of the mirror being at least partially spherical, while the part situated above the said plane with respect to the cap presents a decreasing curvature between the plane and juncture of the envelope and the axis of symmetry of the lamp, the distance between the top of the said upper part in the centre of the spherical part being larger than the radius of the said spherical part.

The lamp comprises a crown filament situated in a plane orthogonal to the axis of symmetry of the lamp.

The reflecting dome formed on the envelope extends towards the cap only to the circle determined by the intersection of the envelope through a plane orthogonal to the symmetry axis and passing slightly below the plane comprising the filament.

In order that the invention may be readily carried into effect, it will now be described in greater detail, by way of example, with reference to the accompanying drawings, in which FIG. 1 shows the path of the stray light rays in a known lamp having a spherical envelope.

Figure 1:
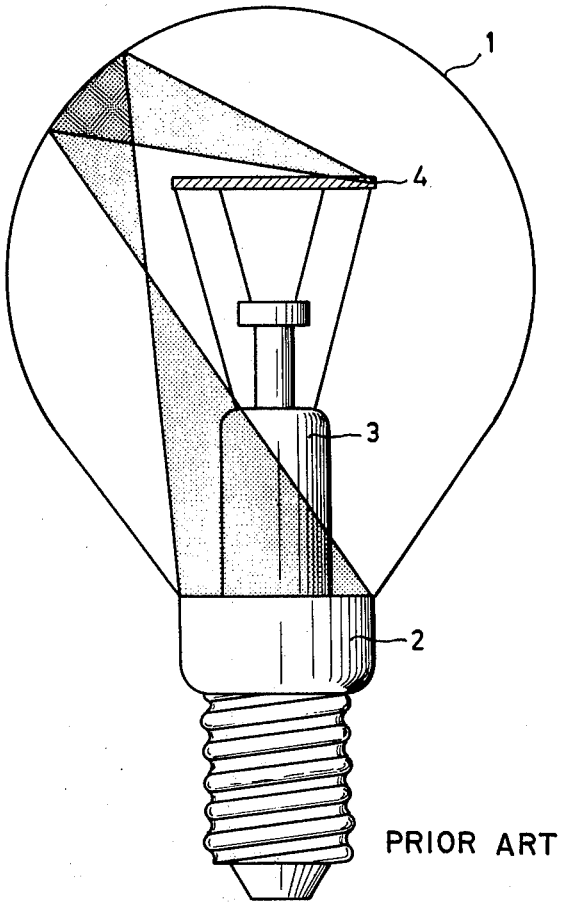

FIG. 1 is a sectional view of a lamp having a spherical envelope 1. Its diameter is 45 mm, its height 74.5 mm, and it comprises a cap 2 of the type Edison 14. The spherical envelope 1 is connected to the cap with the interposition of a cylindrical member 3. The filament 4 situated in the centre of the envelope in a plane orthogonal to the symmetry axis of the lamp is a filament arranged in a ring and operating at a voltage of 220/230 V.

The silvered dome extends towards the cap only to the circle determined by the intersection of the envelope through a plane orthogonal to the symmetry axis of the envelope. The figure shows the envelope of the rays falling on the cap and issued from a point of the filament 4 after reflection on the mirror of the envelope. The solid angle thus determined corresponds to approximately 20°.

Figure 2:
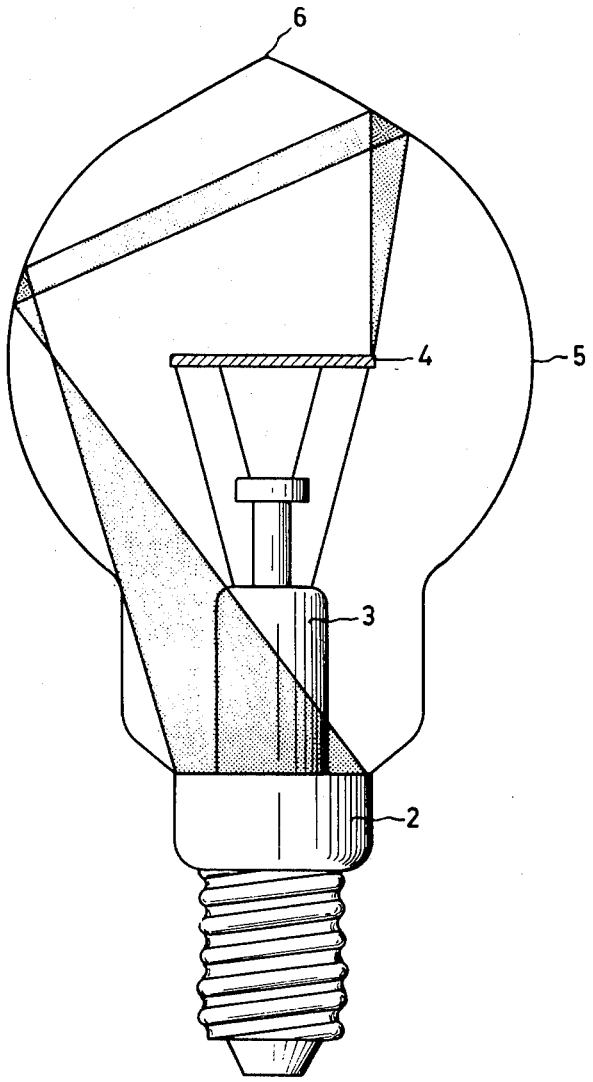
FIG. 2 shows the path of the stray light rays in a lamp having a spheroconical envelope.

FIG. 2 shows the path of the light rays falling on the cap of a lamp according to the invention. The dome of said lamp has such a shape that the rays issued from a point of the filament 4 falling on the said silvered dome experience at least two reflections before reaching the cap.

The embodiment shown in FIG. 2 shows a dome having a spheroconical shape which includes the generally spherical surface of the median part 5 of the envelope and has a decreasing curvature closer to the top 6. The top 6 of the envelope is at a distance from the centre of the spherical part exceeding the radius of the spherical part.

The characteristic of the surface of the dome is such that the rays issued from a point of the filament and reaching the cap must experience two reflections and are emitted at a solid angle of approximately 10°. The calorific and luminous powers thus transported are approximately half less with respect to the lamp having a spherical dome of FIG. 1.

Comparative experiments between lamps having a silvered spherical dome and lamps having a silvered spheroconical dome have been made for powers of 40 W at a voltage of 225 V. Efficiency measurements on said two types of lamp have permitted of proving a gain in the order of 7 percent for the lamp according to the invention as far as the overall light emission is concerned.

Experiments performed on lamps according to the invention of 225 V, 60 W, have proved that the rise in temperature of the cap was less than that obtained with spherical lamps having a silvered dome of 225 V, 40 W, measured, for example, according to the method described in the publication 360 of the "Commission Electrotechnique Internationale".

The experiments have been performed in comparison with a lamp of 40 W, 225 V, for it had so far been impossible to manufacture a satisfactory spherical lamp of 60 W, 225 V due to the considerable rise in temperature of the cap.

Figure 3:
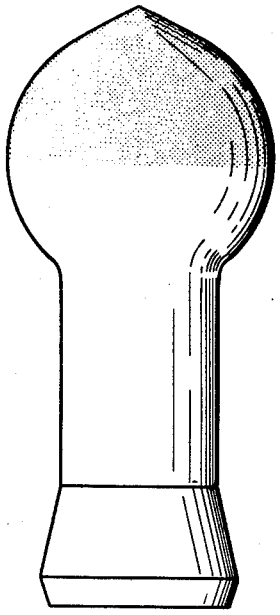
FIG. 3 shows to scale 1 the envelope of the lamp according to the invention.

FIG. 3 shows to full scale a spheroconical envelope according to the invention. The diameter of the envelope is 45 mm, the height of the lamp mounted in the cap is approximately 85 mm. The distance separating the top of the envelope in the centre from the spherical part is approximately 25 mm which represents an increase in height of approximately 2.5 mm with respect to an envelope which is totally spherical. Said spheroconical surface is terminated by a rounding off having a small radius.

What is claimed is:

1. An incandescent lamp which comprises: a filament, a cap and an envelope cooperating with said cap and having a reflecting dome, said envelope including means to divert substantially all the rays issuing from the filament which fall on said dome to experience at least two reflections before reaching said cap.

2. An incandescent lamp as claimed in claim 1, wherein said means includes said envelope having a spheroconical shape, said envelope having an axis of symmetry, said reflecting dome extending from a boundary plane disposed in orthogonal relationship to the axis of said envelope, the part of said spheroconical shape disposed intermediate said boundary plane, and said cap being at least partially spherical and the part of said spheroconical shape disposed on the side of said said boundary plane distal to said cap has a decreasing curvature intermediate said plane and the intersection of said axis of symmetry of the lamp with said lamp at the top of said envelope, the distance between the top and said boundary plane being greater than the radius of the said spherical part.

3. An incandescent lamp as claimed in claim 1 wherein said lamp comprises a filament in the form of a crown disposed in a second plane orthogonal to the axis of symmetry of the lamp.

4. An incandescent lamp as claimed in claim 3 wherein said reflecting dome extends towards the cap to a third plane disposed in orthogonal relationship to the axis of symmetry, said plane being disposed closer to said cap than said second plane.

* * * * *

UNITED STATES PATENT OFFICE

CERTIFICATE OF CORRECTION

Patent No. 4,001,621 Dated January 4, 1977

Inventor(s) Henri Pace et al.

It is certified that error appears in the above-identified patent and that said Letters Patent are hereby corrected as shown below:

On the Title Page, [30] Foreign Application Priority Data delete "Dec. 24, 1974 Spain.....43316".

[73] (assignee) "U. S. Philips Corporation, New York, N.Y."

should be --Fabriques Reunies De Lampes Electriques, Issy Les Moulineaux, (Hauts de Seine) France--.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*